US006238459B1

(12) United States Patent
Downs

(10) Patent No.: US 6,238,459 B1
(45) Date of Patent: May 29, 2001

(54) ULTRA-HIGH PARTICULATE COLLECTION OF SUB-MICRON AEROSOLS

(75) Inventor: William Downs, Washington Township, Stark County, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/298,778

(22) Filed: Apr. 23, 1999

(51) Int. Cl.[7] ..... B03C 3/014

(52) U.S. Cl. ..... 95/64; 55/DIG. 38; 95/65; 95/71; 96/53; 96/275; 261/DIG. 54

(58) Field of Search ..... 95/64, 65, 71; 96/52, 53, 74, 275, 33; 55/DIG. 38; 261/DIG. 54

(56) References Cited

U.S. PATENT DOCUMENTS 2,055,368 * 9/1936 Shively ..... 55/DIG. 38
3,029,578 * 4/1962 Wiemer et al. ..... 261/DIG. 54
3,113,168 * 12/1963 Kinney ..... 96/53 X
3,363,403 * 1/1968 Vicard ..... 261/DIG. 54
3,668,835 * 6/1972 Vicard ..... 261/DIG. 54
3,729,898 * 5/1973 Richardson ..... 261/DIG. 54
3,770,385 * 11/1973 Grey et al. ..... 96/53 X
4,957,512 * 9/1990 Denisov et al. ..... 96/53 X
5,084,072 * 1/1992 Reynolds ..... 95/65
5,344,481 * 9/1994 Pettersson ..... 96/33
5,626,652 * 5/1997 Kohl et al. ..... 55/DIG. 38

* cited by examiner

*Primary Examiner*—Richard L. Chiesa
(74) *Attorney, Agent, or Firm*—R. C. Baraona; Eric Marich

(57) ABSTRACT

A method and apparatus for ultra-high particulate collection of sub-micron aerosols in a fuel gas conveys the fuel gas to a first venturi scrubber for removing a relatively large amount of particulates and leaving a smaller particulate load which is not removable in the first venturi scrubber. The fuel gas with the smaller particulate load is then conveyed to an electrostatic agglomerator for agglomerating the remaining smaller particles in the smaller particle load into larger particles. The fuel gas with the agglomerated larger particles is then conveyed to a second venturi scrubber for removing the agglomerated larger particles.

14 Claims, 3 Drawing Sheets

ULTRA-HIGH PARTICULATE COLLECTION OF SUB-MICRON AEROSOLS

CROSS-REFERENCE TO RELATED APPLICATIONS

Reference is made to the U.S. patent application of Jerry D. Blue, William Downs, Timothy A. Fuller, and Christopher L. Verrill, titled SULFUR RECOVERY FROM SPENT LIQUOR GASIFICATION PROCESS, U.S. Ser. No. 09/298,974, filed Apr. 23, 1999 and the U.S. patent application of Jerry D. Blue, William Downs, Timothy A. Fuller, Christopher L. Verrill, Paul S. Weitzel, and Phung H. M. Chan, titled GASIFICATION PROCESS FOR SPENT LIQUOR AT HIGH TEMPERATURE AND HIGH PRESSURE, U.S. Ser. No. 09/298,533, filed Apr. 23, 1999, the text of which are hereby incorporated by reference as though fully set forth herein. Unless otherwise stated, definitions of terms these applications are valid for this disclosure also.

FIELD AND BACKGROUND OF THE INVENTION

The present invention relates in general to removing particles from gases, and in particular to a new and useful ultra-high particulate collection apparatus and method.

Venturi scrubbers have been used for particulate collection for at least 60 years. The use of venturi scrubbers for particulate collection from coal fired gasifiers is known and has been proposed for use on black liquor gasifiers. Electrostatic precipitation is also well established for fine particulate control. Electrostatic agglomerators are less well known. A form of electrostatic agglomeration is used in the carbon black industry to facilitate the collection of soot sized particles on fabric filters. The use of electrostatic precipitation on fuel gas or synthesis gas from gasifiers has been proposed in the literature but has not actually been commercialized. No prior art is known which proposes use of two venturi scrubbers in combination with an electrostatic agglomerator for the cleanup of any gas borne particulate.

An electrostatic agglomerator/venturi scrubber combination was developed in the 1960's. In the 1960's a Kraft process was operated in the United States with a combination of an electrostatic agglomerator upstream of a single venturi scrubber. The Kraft process is under much less pressure and has much lower particle loading than the output of a black liquor gasifier and would provide the person having ordinary skill in this art with no motivation to include a second upstream venturi scrubber for any purpose.

SUMMARY OF THE INVENTION

An object of the present invention is to provide an improved ultra-high particulate collection system and method which utilizes two venturi scrubbers connected in series with an electrostatic agglomerator connected there between.

A further object of the present invention is to provide a method and apparatus for ultra-high particulate collection which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
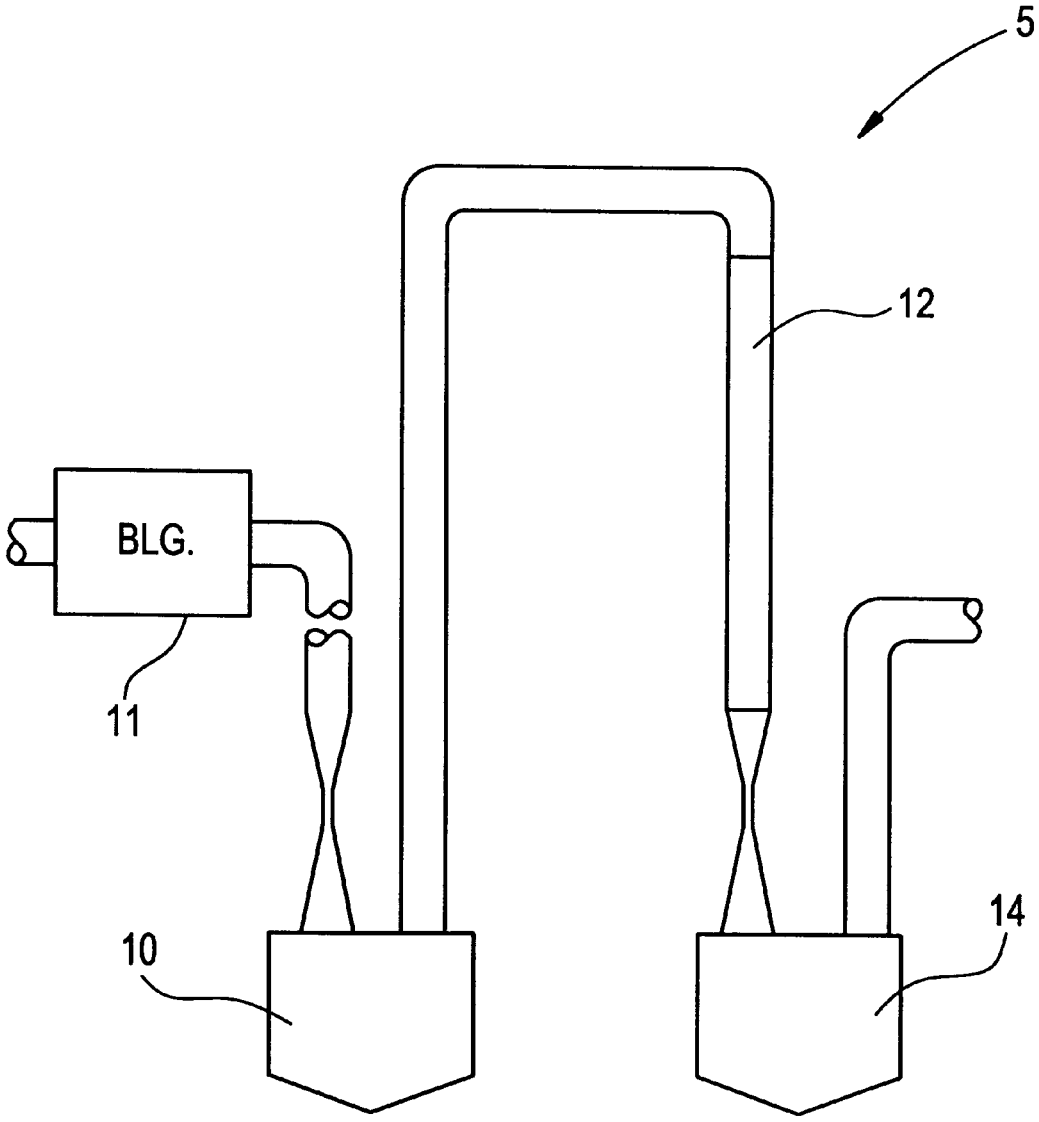
FIG. 1 is a schematic diagram of the present invention.
Figure 2:
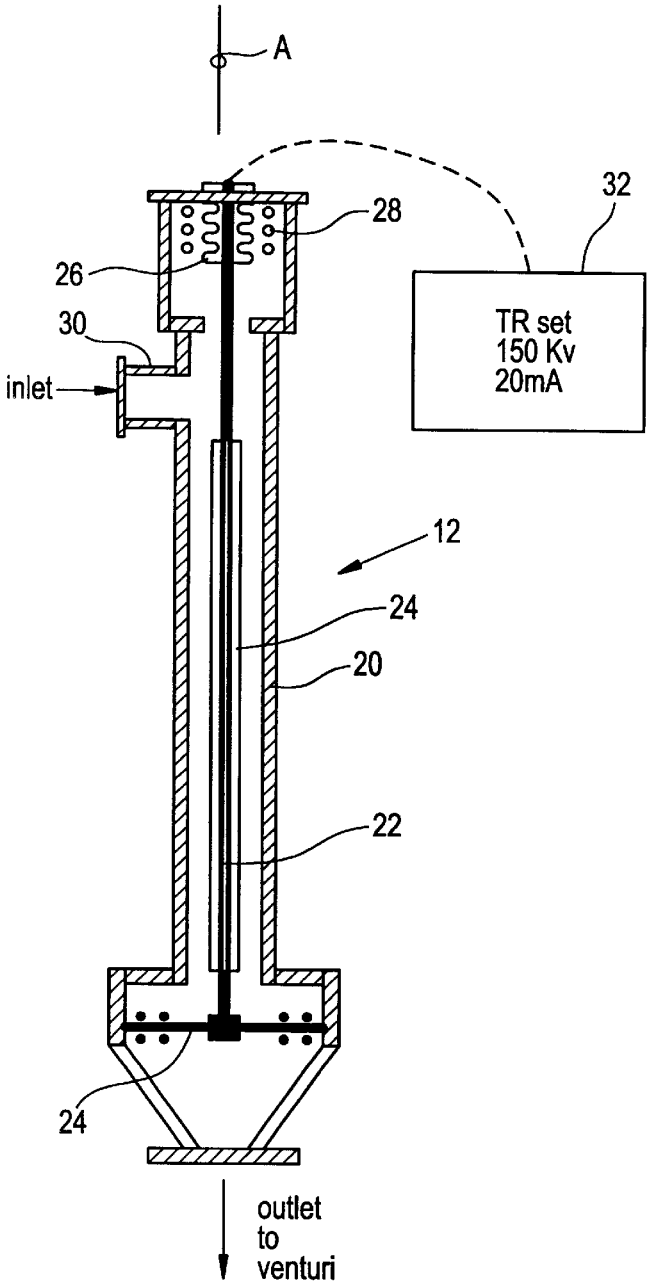
FIG. 2 is a schematic sectional view of an electrostatic agglomerator used in accordance with the present invention.

Referring to the drawings generally, wherein like reference numerals designate the same or functionally similar elements through the several drawings, FIG. 1 illustrates a schematic representation of the invention (generally designated 5); an apparatus and method for ultra-high particulate collection of sub-micron aerosols from a fuel gas. The system 5 comprises a first venturi scrubber 10 followed by an electrostatic agglomerator or ESA 12 which, in turn, is followed by a second venturi scrubber 14. Gas from a black liquor gasifier or BLG 11 is supplied to the venturi scrubber 10. The heart of the system 5 is the electrostatic agglomerator 12. With some notable exceptions, the principle of operation of this electrostatic agglomerator is similar to that of an electrostatic precipitator. The method of charging particles in an electrostatic field with a corona current is the same. In both cases the particles are accumulated on the walls of the grounded surface, e.g. the collection plate. In the case of the electrostatic precipitator, the accumulated dust on the walls of the grounded surfaces are typically rapped in such a way as to slide the dust vertically into hoppers situated below the collection plates. Extreme effort is made to prevent the dust from being re-entrained into the gas stream. The gas velocity is maintained below about 5 ft/sec and the collection surface is designed to discourage mechanical interactions between the gas and the dust layer. In contrast, in this electrostatic agglomerator 12, complete re-entrainment of the dust is required. The actual agglomeration occurs on the collection surface as sub-micron particles come into mechanical contact with one another. The forces holding these agglomerates of sub-micron particles together are far stronger than the aerodynamic forces to which the particles are subjected by the re-entraining flue/fuel gases. Gas velocity restrictions do not apply to the electrostatic agglomerator 12 in the same way that they do apply to conventional electrostatic precipitation. One schematic representation of the electrostatic agglomerator 12 is depicted in FIG. 2.

Before explaining FIG. 2 in detail, the functions of the two venturi scrubbers 10, 14 will be explained. Venturi scrubbers are quite efficient dust collectors for particles greater than about five microns but they are very poor collectors of particles less than about 0.3 microns. Thus, all that is required of the electrostatic agglomerator 12 is that it converts sub-micron fume and aerosol to agglomerates that are at least a few microns in size. Thus, the function of the venturi scrubber 14 following the electrostatic agglomerator 12 is to collect these agglomerates by conventional means.

The function of the venturi scrubber 10 preceding the electrostatic agglomerator 12 is less obvious. A phenomenon known as the"space charge effect" has a deleterious influence on electrostatic separation. This phenomenon occurs when too many charged particles are present in the electric field of the precipitator or electrostatic agglomerator. If the concentration of particulate in the electric field is expressed in terms of grains per cubic foot, the maximum concentration that the precipitator or electrostatic agglomerator can handle without invoking a space charge problem is about 10 grains/ft$^3$. For a black liquor gasification process, the concentration of particulate (alkali fume and soot) could exceed 800 grains/ft$^3$.

The function of the first venturi scrubber 10 is therefore to reduce the dust loading to below 10 grains/ft$^3$ before the fuel gas enters the electrostatic agglomerator 12. Thus, for example, if the dust loading leaving the gasifier is 800 grains/ft$^3$ and if the first venturi scrubber is designed to achieve 99% particulate collection, the dust loading entering the electrostatic agglomerator will be 8 grains/ft$^3$. That would be sufficiently low to prevent the space charge effect from having a significant impact on the electrostatic agglomerator 12. At that point, the electrostatic agglomerator 12 and second venturi scrubber 14 working in combination would be required to operate at a collection efficiency of about 99.97% to achieve the alkali removal requirement necessary to meet the alkali limit specification of the gas turbine manufacturers.

Figure 3:
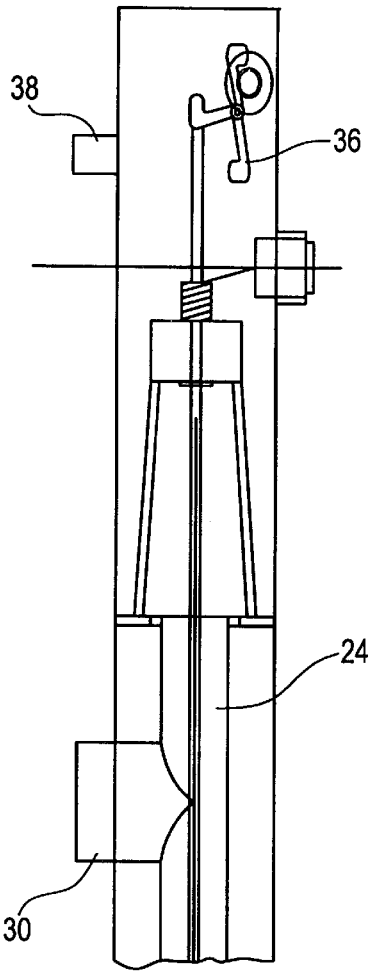
FIG. 3 is a schematic view showing a rapping arrangement according to the present invention.

The design of the electrostatic agglomerator 12 is shown schematically in FIG. 2. For capacities up to about 1500 actual cubic feet per minute, a single tube 20 can be used. This tube 20 can be up to 18 inches inside diameter ID (preferably 12 inches inside diameter), approximately 10 feet long, and serves as the containment as well as the collection surface. A high voltage electrode 22 is located along a central axis A of this collection tube 20. The electrode 22 is isolated from the grounded surface by an insulator 26. The insulator 26 must in turn be protected from dirt and/or condensation by the appropriate application of radiant heaters 28 and clean dry purge gas entering via an inlet 38 (FIG. 3) into tube 20. A single transformer-rectifier (TR) set 32 (150 Kv, 20 mA) is connected to the electrode 22. Both the collection surface 20 and the high voltage electrode 22 must be rapped periodically. Rapping is accomplished by rotating hammers 36 as illustrated schematically in FIG. 3, which raps an upper end of the electrode 22 above an outer sleeve or sheath 24 around part of electrode 22. One or more stabilizing rods 29 shown in FIG. 2 holds the lower end of electrode 22.

Figure 4:
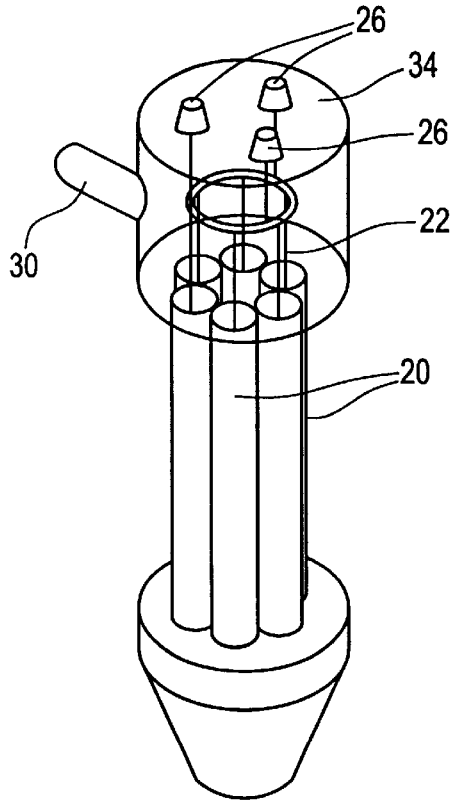
FIG. 4 is a schematic perspective view showing further electrostatic agglomerator according to the present invention.
Figure 5:
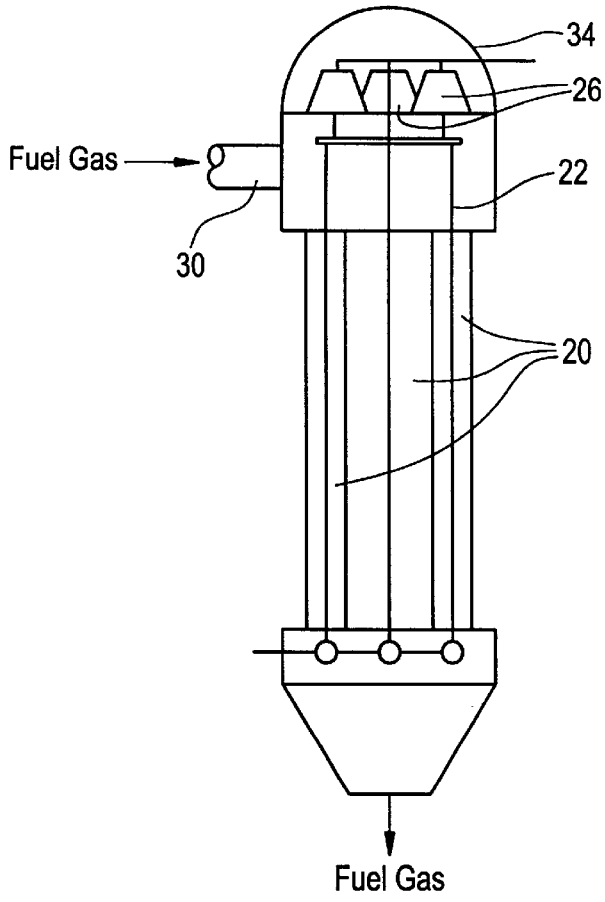
FIG. 5 is a side elevational view showing the agglomerator of FIG. 4.

If the capacity of the electrostatic agglomerator 12 exceeds about 1500 acfm, the design can be modified as per FIG. 4 and FIG. 5. Here, the number of tubes 20 and electrodes 22 are increased in a bundled array as illustrated. Each tube 20 will again be between 12 and 18 inches ID and about 10 feet long. Three insulators 26 support the array of electrodes 22. These insulators are housed in a penthouse 34 that is pressurized with nitrogen $N_2$ to slightly above the operating pressure of the treated fuel gas entering gas inlet 30.

If the black liquor gasifier operates at an exit gas temperature of 1800° F., the sodium compounds in the smelt will be exposed to about the same temperatures as those in a conventional Kraft Recovery boiler (RB). In conventional RB's, the total electrostatic precipitator (ESP) dust catch is typically about 6 to 7% of the total black liquor solids. Although most of the particulate that is formed in the furnace could be classified as fume, as much as a third of it is collected on heat transfer surface in the convection pass. This material becomes agglomerated due to the"sticky" property of salt cake; the collection mechanism is probably thermophoresis. In this black liquor gasifier utilizing a quick quench design, there will be little opportunity for collection of alkali fume on heat transfer surface by thermophoresis. For this gasifier operating at an exit gas temperature of 1800° F., the commercial scale unit (for a 1000 ton per day pulp mill) is estimated here to generate up to about 8000 pounds per hour of alkali fume of which about 35% would be sodium (Na) and potassium (K). That equates to about 2800 pounds per hour of Na and K. The total fuel gas flow for this commercial scale gasifier is about 110,000 pounds per hour. The uncontrolled alkali concentration in the fuel gas is therefore about 25,000,000 parts per billion by weight. The allowable limit of alkali in the gas going to the gas turbine is 20 parts per billion. The fuel gas is diluted significantly before entering the gas turbine. Accounting for dilution with combustion air, the allowable alkali in the fuel gas will be about 85 parts per billion by weight. Based on these estimates, an overall alkali removal efficiency of 99.9997% ("five nines"removal efficiency) will be required to meet this performance level. This level of particulate control is extreme. This problem coupled with the high pressure of the fuel gas is the challenge that this combination of venturi scrubbers 10, 14 and electrostatic agglomerator 12 is designed to accomplish.

The electrostatic agglomerator and venturi scrubber arrangement (10, 12 and 14) of the present invention is designed for 99.9999$^+$% efficiency, an efficiency that is unparalleled in industrial practice. According to the present invention, most of the particulate is removed by the upstream venturi scrubber 10 and the electrostatic agglomerator 12 is thus used for its unexpected effect on the remaining smaller particles which are particularly advantageous when applied to the smaller particles remaining in the black liquor gasifier fuel gas. In a test of particulate removal with an electrostatic agglomerator and venturi scrubber combination (12 and 14 only) behind a Kraft recovery boiler, performance exceeded 99.94%.

Because the process operates at high pressure (over 20 bar), compact equipment offers significant cost and engineering design savings. The venturi scrubber operates at throat velocities that are typically greater than 200 feet per second. For this application, however, the gas velocity will exceed 300 ft/sec. Thus, a venturi scrubber with a circular cross-section and throat diameter of 8 inches can handle the full flow of fuel gas from a 1000 ton per day pulp mill.

Various alternative designs of the electrostatic agglomerator are feasible. Although a downflow direction of the fuel/flue gas through the electrostatic agglomerator will normally be preferred, upflow and cross flow designs could also be envisioned. The use of a venturi scrubber is also a preferred embodiment of this patent. But, other devices such as cyclone separators or fabric filters could also be used to collect the agglomerates leaving the electrostatic agglomerator 12.

While a specific embodiment of the invention has been shown and described in detail to illustrate the application of the principles of the invention, it will be understood that the invention may be embodied otherwise without departing from such principles.

I claim:

1. A method for ultra-high particulate collection of submicron aerosols in a fuel gas, comprising:

providing a fuel gas under pressures exceeding 10 bar, the fuel gas also having an initial particulate loading between 8 grains/ft$^3$ and about 800 grains/ft$^3$;

conveying the fuel gas to a first venturi scrubber for removing a relatively large particulate load in the fuel gas and leaving smaller particulate load in the fuel gas which is not removed in the first venturi scrubber;

conveying the fuel gas with the small particulate load to an electrostatic agglomerator for agglomerating smaller particles into larger particles; and conveying the gas with larger particles to a second venturi scrubber for removing the larger particles.

2. The method according to claim 1, including operating the first venturi scrubber at an efficiency of about 99% and operating the second venturi scrubber at an efficiency of over 99.9%.

3. The method according to claim 1, wherein the fuel gas is provided from a black liquor gasifier.

4. The method according to claim 1, including conveying the fuel gas with the small particulate load to the electrostatic agglomerator at a velocity of greater than 5 ft/sec.

5. The method according to claim 4, including removing particles from the fuel gas in the first venturi scrubber to leave the smaller particulate load in the fuel gas having a particle loading below about 10 grains/$ft^3$.

6. The method according to claim 5, including conveying the fuel gas to the first venturi scrubber at a pressure of over about 20 bar.

7. The method according to claim 6, including accelerating the fuel gas within the first venturi scrubber to a velocity of over 300 ft/sec.

8. An apparatus for ultra-high particulate collection of sub-micron aerosols in a fuel gas at high pressures, comprising:

a first venturi scrubber means for reducing particulate matter from a fuel gas having an initial particulate loading between 8 grains/$ft^3$ and about 800 grains/$ft^3$;

means for conveying the fuel gas to the first venturi scrubber for removing a relatively large particulate load from the fuel gas and leaving a smaller particulate load in the fuel gas which is not removed in the first venturi scrubber and capable of operating at a pressure greater than 10 bar;

an electrostatic agglomerator;

means for conveying the fuel gas with the smaller particulate load to the electrostatic agglomerator for agglomerating the particles in the smaller particle load into larger particles and capable of operating at a pressure greater than 10 bar;

a second venturi scrubber means for further reducing particulate matter from the fuel; and means for conveying the fuel gas with the agglomerated larger particles to the second venturi scrubber for removing the agglomerated larger particles and capable of operating at a pressure greater than 10 bar.

9. The apparatus according to claim 8, including means for operating the first venturi scrubber at an efficiency of about 99% and means for operating the second gas venturi scrubber at an efficiency of over 99.9%.

10. The apparatus according to claim 8, including means for supplying the fuel gas from a black liquor gasifier.

11. The apparatus according to claim 8, wherein the electrostatic agglomerator includes a single electrostatic agglomerator tube having an inside diameter and an electrode extending along the inside diameter.

12. The apparatus according to claim 8, wherein the electrostatic agglomerator includes a plurality of tubes, each tube having an electrode.

13. The apparatus according to claim 8, including means for accelerating the fuel gas within the first venturi scrubber to a velocity of over 300 feet per second and supplying the fuel gas at a pressure of over about 20 bar.

14. The apparatus according to claim 13, including means in the first venturi scrubber for reducing the large particulate load in the fuel gas to the smaller particulate load having a particle loading below about 10 grains/$ft^3$.

* * * * *